US012435949B2

(12) United States Patent
Considine et al.

(10) Patent No.: US 12,435,949 B2
(45) Date of Patent: Oct. 7, 2025

(54) DEEP CONCEALMENT HOLSTER ASSEMBLY

(71) Applicants: Jules Considine, Beaverton, OR (US); Jonathan Hauptman, Maplewood, MN (US); Sarah Cade Hauptman, Maplewood, MN (US)

(72) Inventors: Jules Considine, Beaverton, OR (US); Jonathan Hauptman, Maplewood, MN (US); Sarah Cade Hauptman, Maplewood, MN (US)

(73) Assignees: Jules Considine, Beaverton, OR (US); Jonathan Hauptman, Maplewood, MN (US); Sarah Cade Hauptman, Maplewood, MN (US)

( * ) Notice: Subject to any disclaimer, the term of this patent is extended or adjusted under 35 U.S.C. 154(b) by 233 days.

(21) Appl. No.: 18/295,165

(22) Filed: Apr. 3, 2023

(65) Prior Publication Data

US 2023/0258428 A1 Aug. 17, 2023

Related U.S. Application Data

(62) Division of application No. 16/950,779, filed on Nov. 17, 2020, now Pat. No. 11,629,930.

(51) Int. Cl.
*F41C 33/04* (2006.01)
*F41C 33/02* (2006.01)

(52) U.S. Cl.
CPC ..... *F41C 33/048* (2013.01); *F41C 33/0236* (2013.01); *F41C 33/043* (2013.01); *F41C 33/046* (2013.01)

(58) Field of Classification Search
CPC .... F41C 33/048; F41C 33/046; F41C 33/043; F41C 33/0236; F41C 33/02; F41C 33/041
See application file for complete search history.

(56) References Cited

U.S. PATENT DOCUMENTS

| | | | | |
|---|---|---|---|---|
| 3,894,667 | A | 7/1975 | Baldocchi | |
| 4,258,871 | A * | 3/1981 | McMahon | F41C 33/0209 224/192 |
| 4,971,236 | A | 11/1990 | Grummet | |
| 5,269,448 | A | 12/1993 | Shoemaker | |
| 7,258,259 | B1 | 8/2007 | Owens | |
| 7,314,152 | B1 | 1/2008 | Garrett | |
| 9,696,113 | B2 * | 7/2017 | Tedder | F41C 33/0263 |
| 9,958,233 | B2 | 5/2018 | Considine | |
| 11,054,216 | B1 | 7/2021 | Rogers et al. | |
| 2003/0075574 | A1 | 4/2003 | Mossman | |
| 2011/0233244 | A1 | 9/2011 | Platts | |
| 2014/0097216 | A1 | 4/2014 | Rogers | |

(Continued)

OTHER PUBLICATIONS

Arrowhead Tactical Apparel Website, https://arrowheadtacticalapparel.com/products/carrier-jogger, Nov. 17, 2020, 5 Pages.

(Continued)

*Primary Examiner* — Corey N Skurdal
(74) *Attorney, Agent, or Firm* — Berkeley Law & Technology Group, LLP

(57) ABSTRACT

Example implementations relating to a deep concealment holster assembly are disclosed herein. In one particular implementation, a holster specifically designed and/or structured for a waist belt concealment may be adapted for a deep concealment.

19 Claims, 12 Drawing Sheets

(56) References Cited

U.S. PATENT DOCUMENTS

| | | | |
|---|---|---|---|
| 2014/0131410 | A1 | 5/2014 | Looper et al. |
| 2016/0061563 | A1 | 3/2016 | Bowman |
| 2016/0102940 | A1 | 4/2016 | Sykes et al. |
| 2016/0209164 | A1 | 7/2016 | Fravala |
| 2017/0089666 | A1 | 3/2017 | Considine |

OTHER PUBLICATIONS

Dynamis Alliance Website, https://dynamisalliance.com/product-category/apparel/mens/bottoms/iws/, Nov. 17, 2020, 2 Pages.
Galco Holsters Website, https://www.galcogunleather.com/underwraps-belly-band-2-0_8_393_1518.html, Nov. 17, 2020, 7 Pages.
SmartCarry Website, https://www.smartcarry.com/single-gun-holster, Nov. 17, 2020, 5 Pages.
Unity Tactical Website, https://www.unitytactical.com/product/clutch-belt/ , Nov. 17, 2020, 5 Pages.
Dene Adams Website, https://deneadams.com/collections/corset-holsters, Nov. 17, 2020, 2 Pages.
Office Action, U.S. Appl. No. 16/950,779, Mailed Mar. 28, 2022, 12 Pages.
Response to Office Action, U.S. Appl. No. 16/950,779, filed Jun. 28, 2022, 13 Pages.
Final Office Action, U.S. Appl. No. 16/950,779, Mailed Sep. 20, 2022, 7 Pages.
Response to Final Office Action, U.S. Appl. No. 16/950,779, filed Nov. 21, 2022, 15 Pages.
Advisory Action, U.S. Appl. No. 16/950,779, Mailed Dec. 2, 2022, 5 Pages.
RCE/Amendment, U.S. Appl. No. 16/950,779, filed Dec. 19, 2022, 18 Pages.
Notice of Allowance, U.S. Appl. No. 16/950,779, Mailed Jan. 20, 2023, 7 Pages.
Issue Fee, U.S. Appl. No. 16/950,779, filed Mar. 13, 2023, 5 Pages.

* cited by examiner

DEEP CONCEALMENT HOLSTER ASSEMBLY

This is a divisional of U.S. patent application Ser. No. 16/950,779 titled "DEEP CONCEALMENT HOLSTER ASSEMBLY," filed on Nov. 17, 2020, which is incorporated herein by reference in its entirety.

BACKGROUND

1. Field

The present disclosure relates generally to firearm accessories and, more particularly, to a deep concealment holster assembly.

2. Information

In the realm or domain of deep concealment holsters, such as holsters that may be worn underneath one or more layers of clothing and/or not inherently and/or necessarily exposed to the topmost layer, for example, improving tactical ability of a user to draw and/or re-holster a firearm with one hand without sacrificing or compromising wearing comfort may be as important as firearm concealability. These or like holsters, however, are typically made out of fabric, such as to provide more comfort against the wearer's skin, for example, but, at times, may snag on sights or other gun parts, quickly become frayed, come out of clothing (e.g., pants, etc.) during a draw-stroke, present issues with re-holstering due, at least in part, to collapsed holster entry point, or the like.

Deep concealment hybrid holsters, such as holsters typically made out of two different types of material, such as a more rigid shell (e.g., hard plastic, etc.) overlaying a more flexible and/or cushioned backing (e.g., padded fabric, leather, etc.) to create a holster pocket or body, for example, may also present challenges. For example, at times, these or like holsters may require an additional and/or separate supporting platform or feature, such as a sufficiently stiff leather or like trouser belt to anchor or attach the holster and/or provide a sufficient firearm retention via tension of the belt, among other things, which may be achieved predominantly while such a holster is worn. Another challenge may include a fabric or leather backing intruding into a trigger guard, such as during re-holstering, as one possible example, which may depress a trigger and create a risk of accidental or negligent discharge for certain firearms, such as firearms without a manual safety. A leather or fabric backing may also increase a holster's profile, for example, which, in turn, may negatively affect its overall concealability. Accordingly, how to implement a deep concealment holster that may be worn with unstructured or beltless clothing (e.g., yoga-type pants, elastic waist khakis, etc.), for example, while retaining or maximizing holster's tactical ability (e.g., one-handed withdrawal, re-holstering, etc.) without compromising concealability and/or everyday wearing comfort continues to be an area of development.

BRIEF DESCRIPTION OF THE DRAWINGS

Claimed subject matter is particularly pointed out and distinctly claimed in the concluding portion of the specification. However, both as to organization and/or method of operation, together with objects, features, and/or advantages thereof, it may be best understood by reference to the following detailed description if read with the accompanying drawings in which:

Figure 1A:
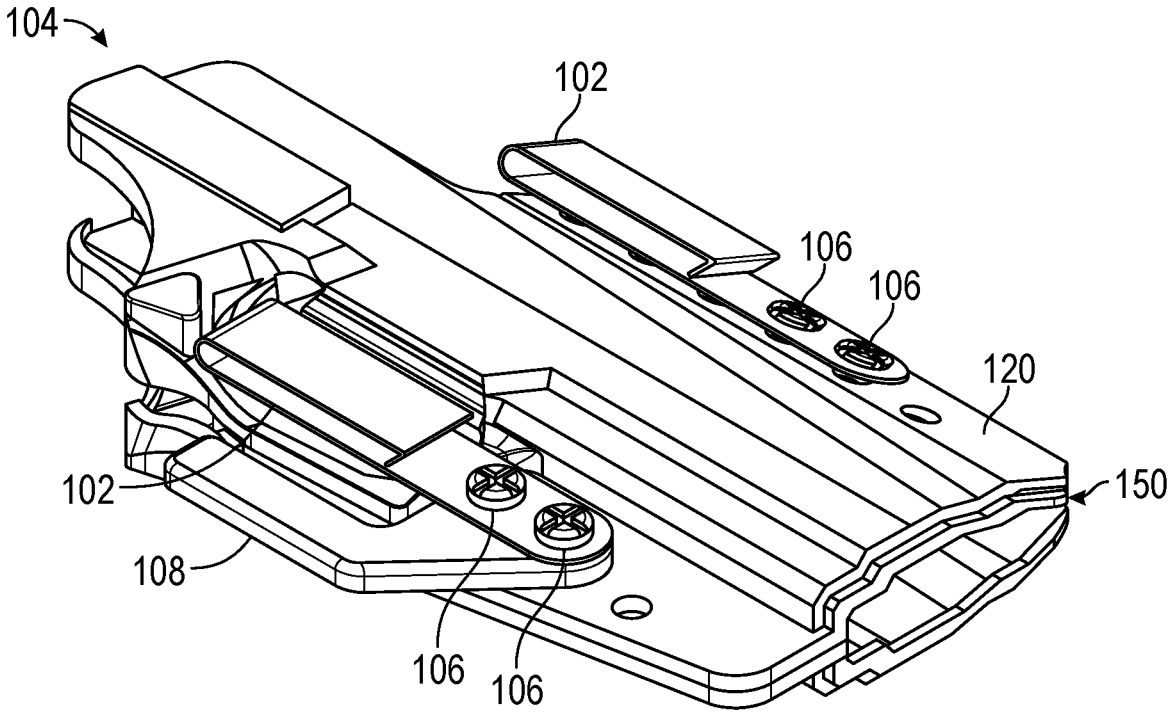
FIGS. 1A and 1B are schematic views of a firearm holster that is adapted for waist belt-attached concealment of a firearm, according to an embodiment.

Reference is made in the following detailed description to accompanying drawings, which form a part hereof, wherein like numerals may designate like parts throughout that are corresponding and/or analogous. It will be appreciated that the figures have not necessarily been drawn to scale, such as for simplicity and/or clarity of illustration. For example, dimensions of some aspects may be exaggerated relative to others. Further, it is to be understood that other embodiments may be utilized. Furthermore, structural and/or other changes may be made without departing from claimed subject matter. References throughout this specification to "claimed subject matter" refer to subject matter intended to be covered by one or more claims, or any portion thereof, and are not necessarily intended to refer to a complete claim set, to a particular combination of claim sets (e.g., method claims, apparatus claims, etc.), or to a particular claim. It should also be noted that directions and/or references, for example, such as up, down, top, bottom, and so on, may be used to facilitate discussion of drawings and are not intended to restrict application of claimed subject matter. Therefore, the following detailed description is not to be taken to limit claimed subject matter and/or equivalents.

DETAILED DESCRIPTION

References throughout this specification to one implementation, an implementation, one embodiment, an embodiment and/or the like means that a particular feature, structure, and/or characteristic described in connection with a particular implementation and/or embodiment is included in at least one implementation and/or embodiment of claimed subject matter. Thus, appearances of such phrases, for example, in various places throughout this specification are not necessarily intended to refer to the same implementation or to any one particular implementation described. Furthermore, it is to be understood that particular features, structures, and/or characteristics described are capable of being combined in various ways in one or more implementations and, therefore, are within intended claim scope, for example.

In general, of course, these and other issues vary with context. Therefore, particular context of description and/or usage provides helpful guidance regarding inferences to be drawn.

According to an embodiment, a "holster" as referred to herein means a structure forming a compartment into which a weapon (e.g., pistol) may be drawn from or secured. For example, a weapon may snugly fit into a holster which attaches to a belt, strap, or saddle so that it may be carried or transported, and be available to be drawn. In the case of securing a pistol, a holster may a comprise united body with interior at least partially conforming to a shape of a particular pistol, and be capable of releasably retaining the pistol therein while substantially covering a barrel, a trigger and a trigger guard, for example. In addition to securing a weapon, a structure providing a holster may also be capable of retainably securing an ammunition magazine, flashlight, cell phone, appropriate tool(s), or other item(s), such as instead of or in addition to a weapon. According to an embodiment, a "holster assembly" as referred to herein means an apparatus that may facilitate transportation of a holster such as structures that may enable attachment of such a holster to a wearers body and/or clothing.

Figure 10A:
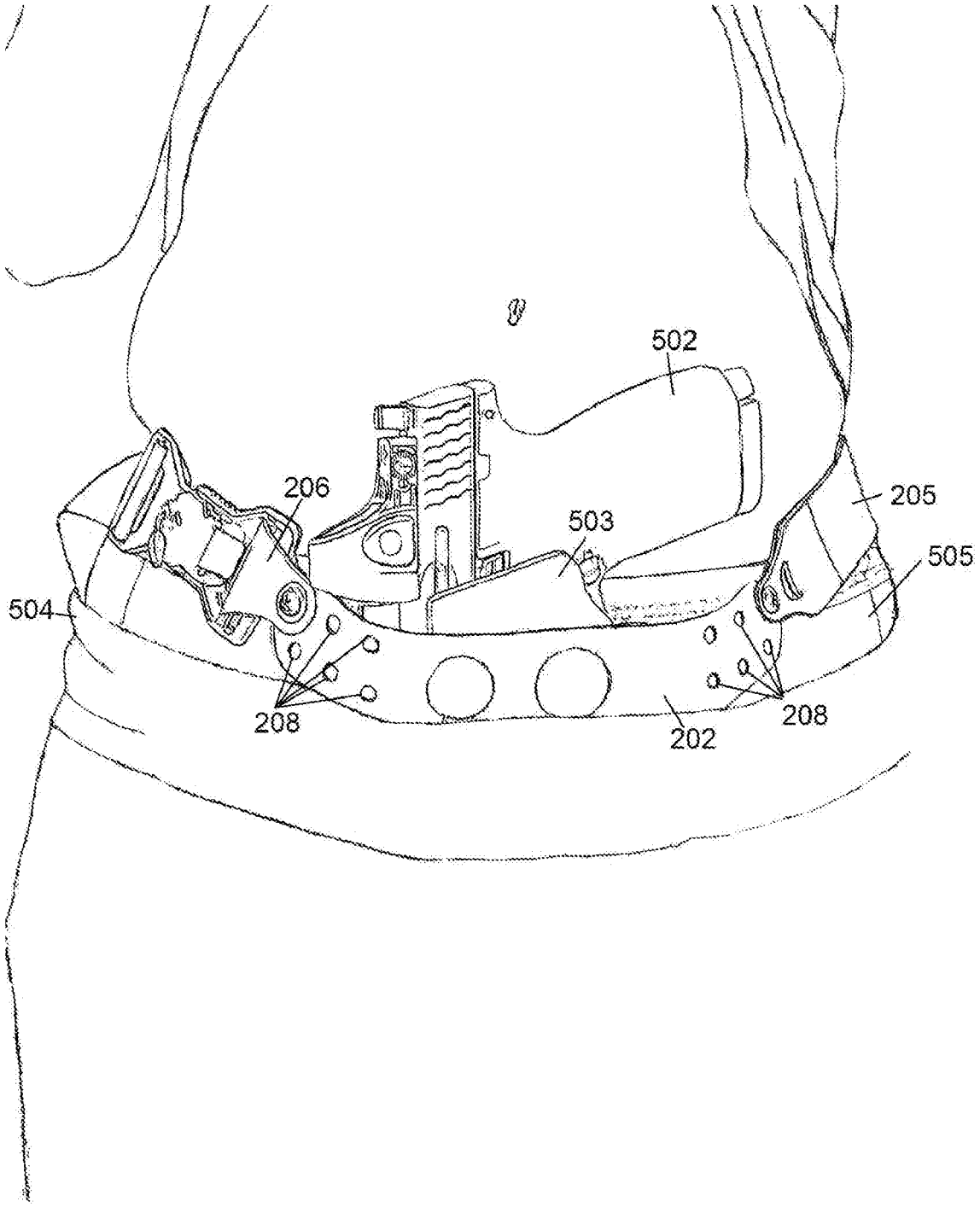
FIGS. 10A and 10B are schematic views illustrating an implementation of a deep concealment holster assembly positioned on a wearer according to an embodiment.
Figure 10B:
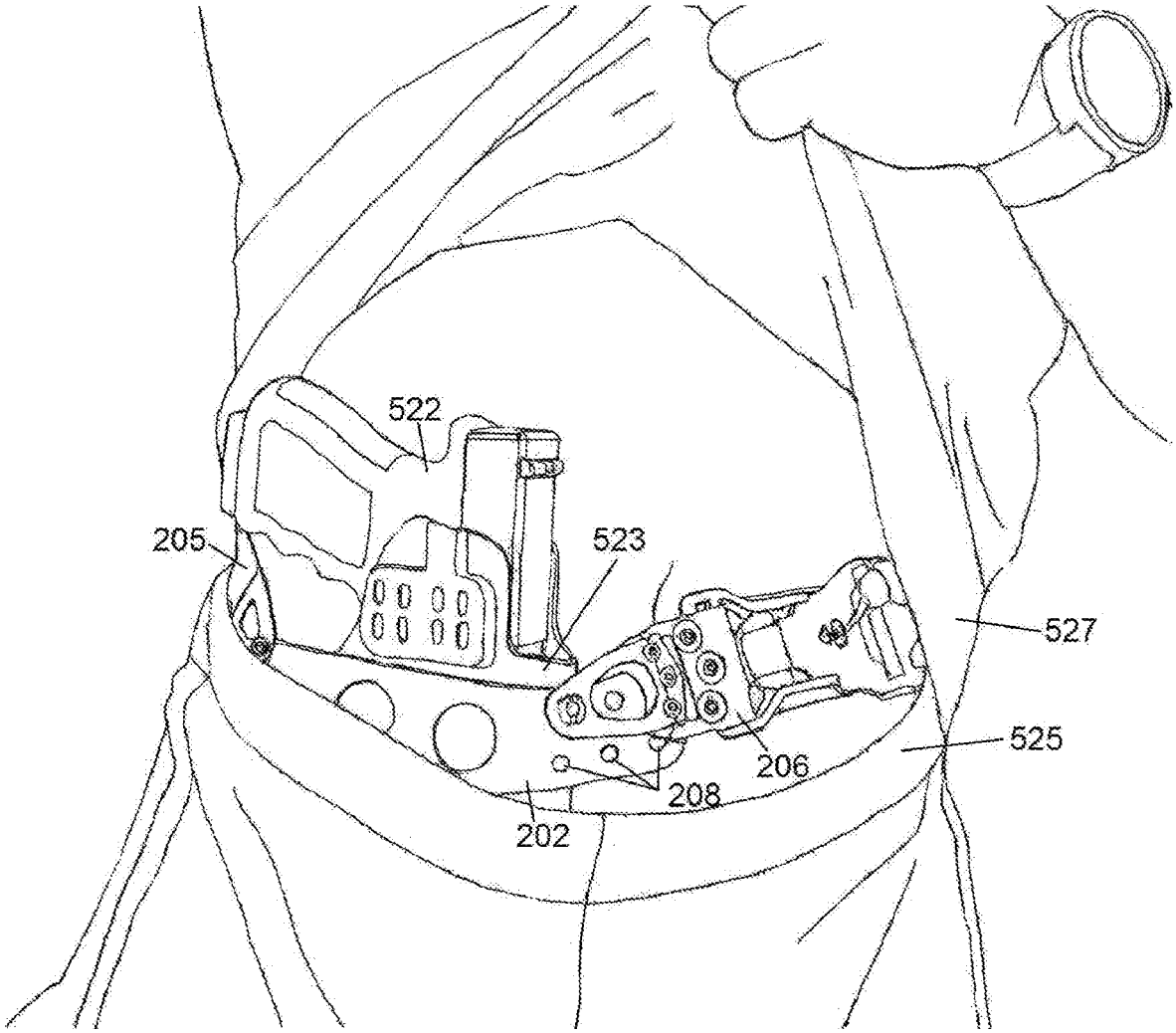
Figure 11:
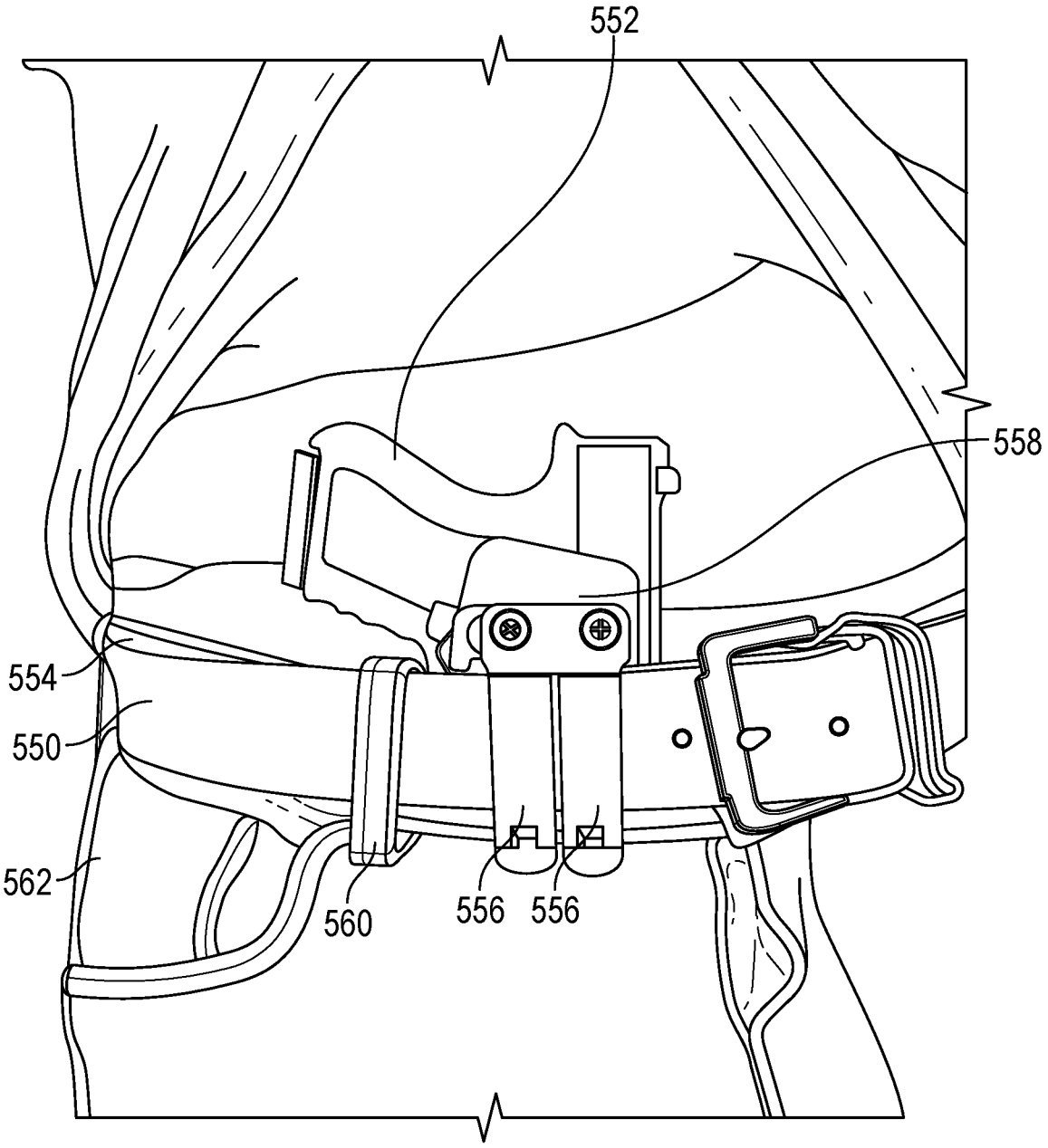
FIG. 11 is a schematic view illustrating an implementation of a waist belt concealment holster assembly positioned on a wearer according to an embodiment.

According to an embodiment, and as shown in FIG. 11 in a particular example, a holster assembly may be adapted to be worn in a manner to facilitate a "waist belt-attached" concealment in which a holster is combined with one or more structures to attach the holster to suspend from a wearer's pant waist and/or waist belt (e.g., waist belt to be pulled through loops on a garment to be worn on the outside of the garment). Alternatively, depending on a particular situation and/or a desired level of tactical readiness, comfort and/or choice of clothing, a wearer of a holstered weapon prefer a "deep concealment" of the holstered weapon as shown in FIGS. 10A and 10B. In an implementation, a deep concealment holster assembly (e.g., facilitating a deep concealment of a holstered weapon) may comprise, for example, a stand-alone unit capable of being worn with unstructured clothing, such as clothing that may be worn without support of a waist belt or pant waist (e.g., under a dress), for example, without sacrificing overall functionality and/or concealability of the holstered weapon. In an implementation, a deep concealment holster assembly discussed herein may better conform to an applicable portion and/or shape of a wearer's body, at-rest and/or in-motion, may provide for more consistent retention of a firearm or other item regardless of presence and/or tension of a trouser belt, may allow for one-handed withdrawal and/or re-holstering, may address or alleviate skin irritability issues, and/or may provide for more consistent positioning and/or orientation of a holstered weapon on a wearer's body, among other things.

From time to time a firearm owner may choose different types of concealment (e.g., deep concealment or waist belt-attached concealment) based, for example, on particular clothing choices, desired comfort and/or potential tactical situations. To have an option to conceal a firearm in a deep concealment manner or a waist belt-attached concealment manner, an owner may purchase two different holsters, one holster being solely adapted for deep concealment and another holster being solely adapted for waist belt-attached concealment.

According to an embodiment, a holster that is specifically designed and/or structured for a waist belt-attached concealment may be adapted to enable a wearer to purpose the holster for a deep concealment. In a particular implementation, a holster assembly may comprise an adapter to be secured against a wearer's body; and one or more fasteners to detachably affix the adapter to a weapon holster wherein the weapon holster is initially designed and/or structured to be worn on a waist belt and/or pant waist for a waist belt-attached concealment. Here, such an adapter may conform to a wearer's body to secure the weapon holster against the wearer's body for a deep concealment. By enabling use of such a holster that is specifically designed and/or structured for a waist belt-attached concealment for a deep concealment, a holster assembly may enable a firearm owner to use the same holster for either waist belt-attached concealment or deep concealment while avoiding the cost of purchasing two holsters.

Referring now to FIGS. 1A-9, which are schematic illustrations of implementations of a deep concealment holster assembly. It should be noted that like numerals may designate like parts throughout to indicate corresponding and/or analogous components. It will also be appreciated that components illustrated have not necessarily been drawn to scale, such as for simplicity and/or clarity of illustration. For example, dimensions of some components may be exaggerated relative to other components. Further, it is to be understood that other embodiments may be utilized. Furthermore, structural and/or other changes may be made without departing from the scope and spirit of claimed subject matter. It should also be noted that directions and/or references, such as, for example, up, down, top, bottom, and so on, if applicable or appropriate, may be used to facilitate or support discussion and are not intended to restrict application of claimed subject matter. Therefore, the following detailed description is not to be taken to limit claimed subject matter and/or equivalents.

Figure 1B:
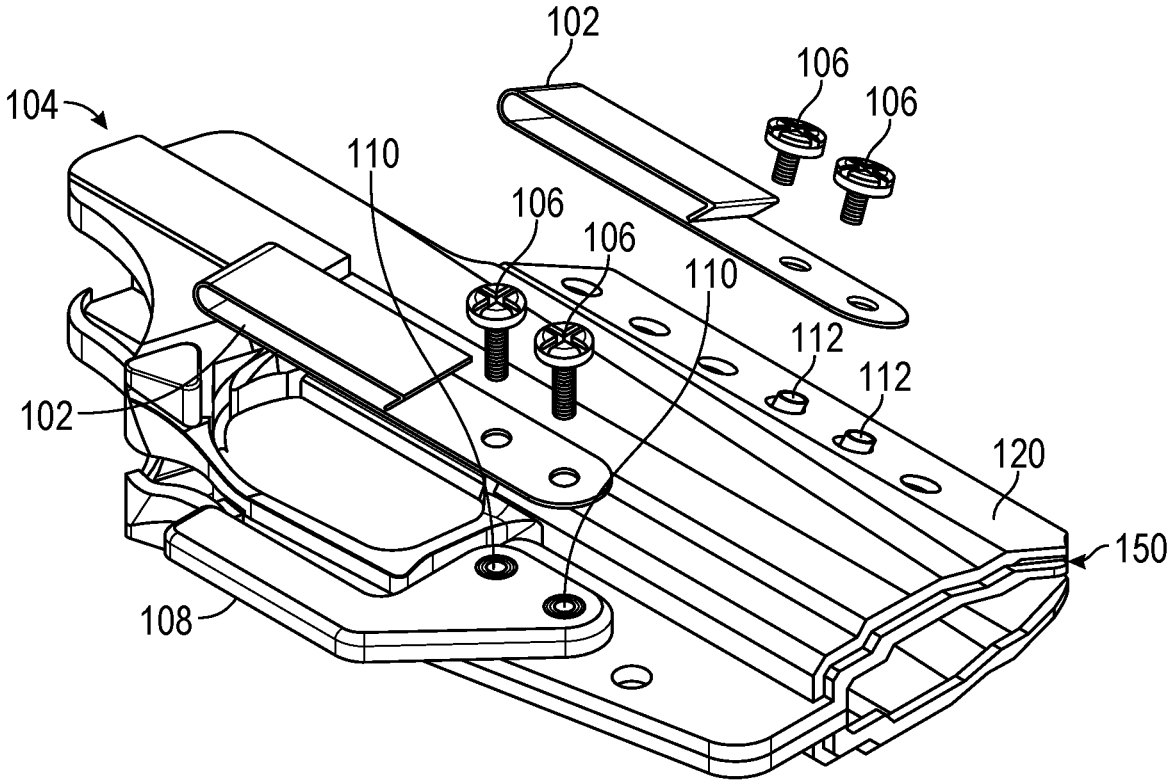

FIGS. 1A and 1B are schematic views of a firearm holster that is specifically designed and/or structured for waist belt-attached concealment of a firearm, according to an embodiment. Holster 150 shown in FIG. 1A includes a cavity 104 in which a firearm may be placed and from which the firearm may be drawn. Overhooks 102 may be securely fastened to a holster body 120 by machine screws 106. In other implementations, overhooks may securely attached to holster body 120 using other types of fastener enabling convenient detachment of overhooks 102 from holster body 120. Overhooks 102 may comprise sheet metal (e.g., stainless steel, aluminum or nickel plated) shaped and/or formed as shown in FIG. 1A. Overhooks 102 may elastically deform to open and close over a belt and/or pant waist so that holster 150 may hang (e.g., from force of gravity) from over a wearer's belt and/or pant waist. Holes 110 and 112 may be thread to match threading on machine screws 106. Holster body 120 may be comprise a commercial off-the-shelf (COTS) holster formed from a substantially rigid material, such as a thermoplastic acrylic-polyvinyl chloride (PVC)-type composite, such as Kydex®, Boltaron®, etc., just to identify a few possible materials. Wing feature 108 may be movable to enable positioning of holster body 120 for a particular orientation while worn. As shown in FIG. 1B, removal of machine screws 106 from holes 110 and 112 may enable removal of overhooks 102. As discussed herein, removal of overhooks 102 may enable a repurposing of holster 150 for use in a deep concealment.

Figure 2:
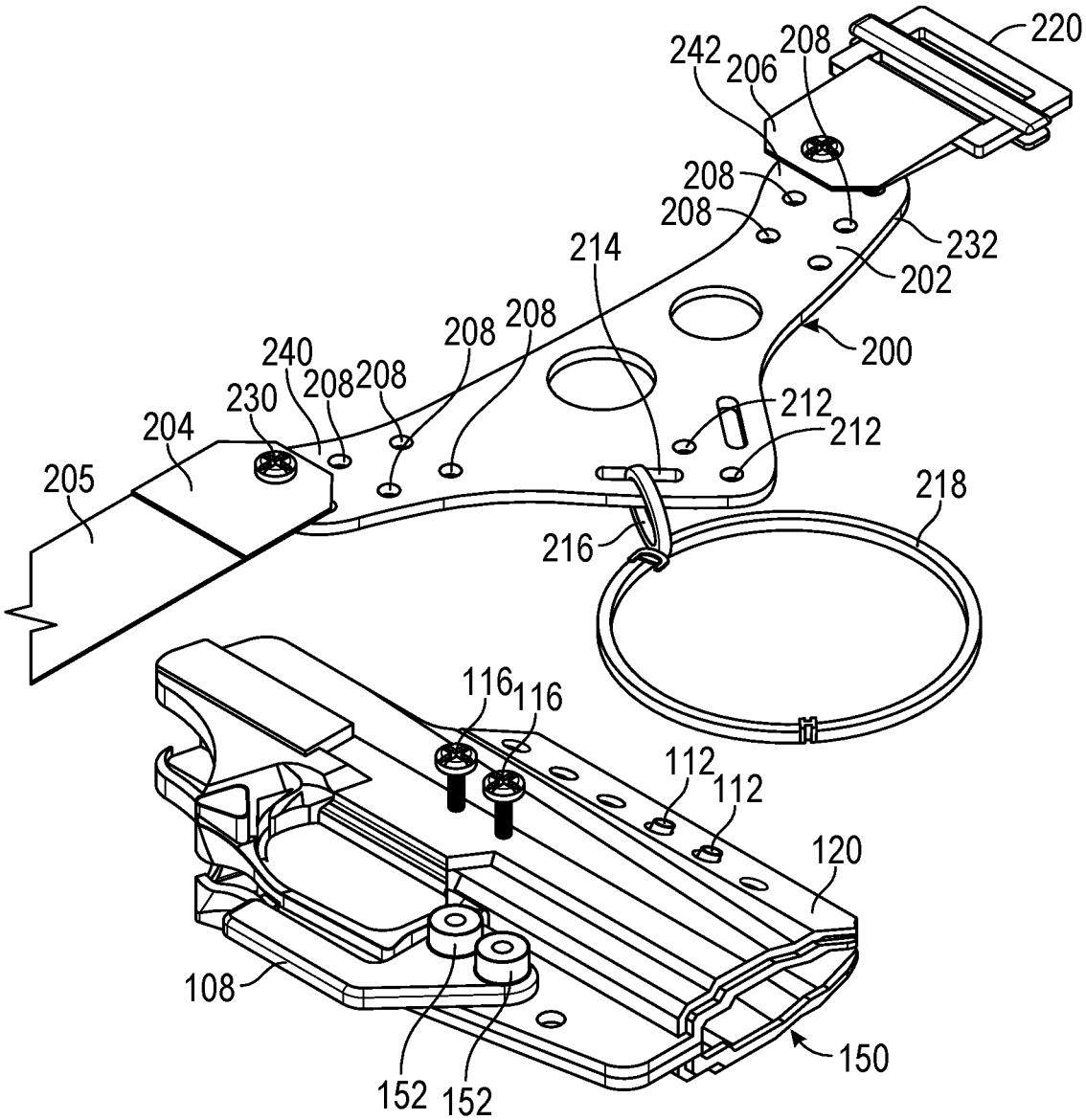
FIG. 2 is a schematic view of an apparatus to adapt a firearm holster for deep concealment according to an embodiment.
Figure 3A:
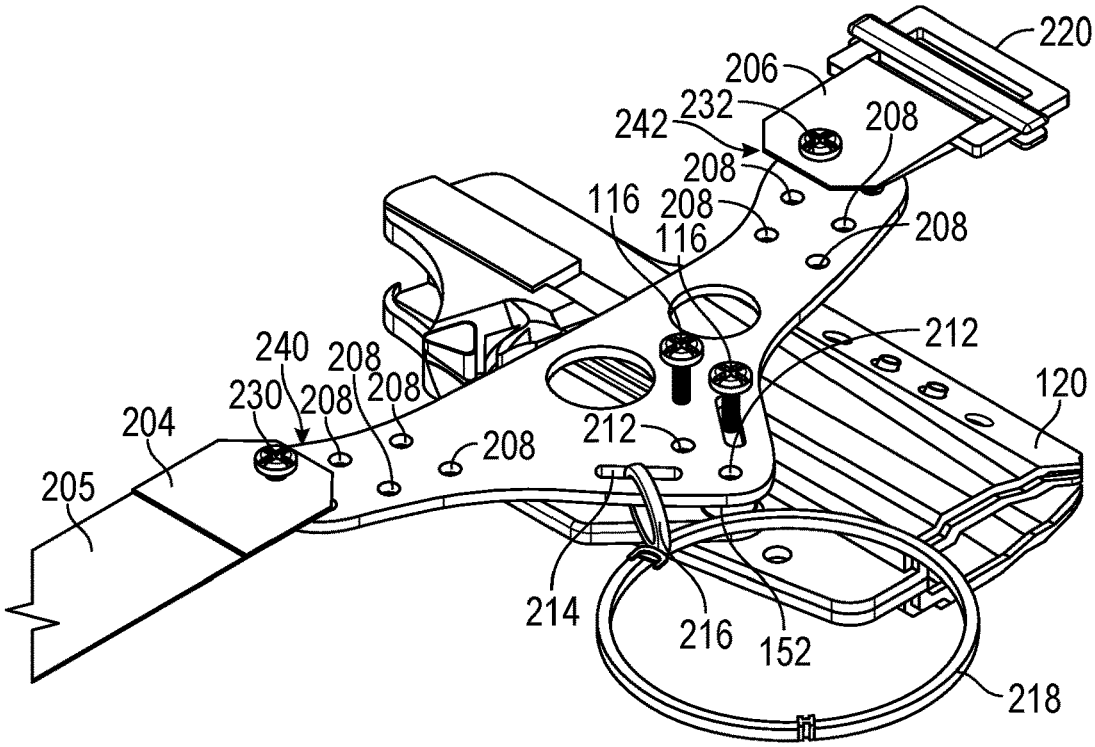
FIGS. 3A and 3B are schematic views of an apparatus to be fastened to a firearm holster to adapt a firearm holster for deep concealment according to an embodiment.
Figure 3B:
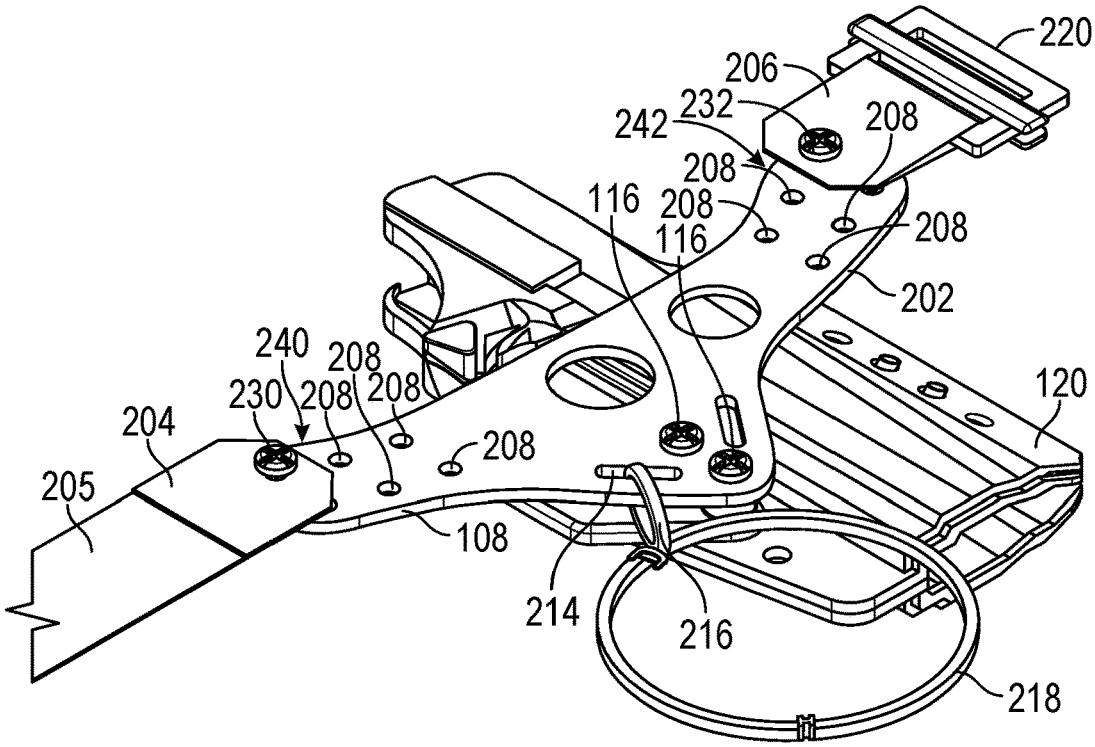

FIG. 2 is a schematic view of an apparatus to adapt a firearm holster for deep concealment according to an embodiment. In an embodiment, holster 150 (with overhooks 102 removed as shown in FIG. 1B), may be coupled to holster assembly 200 to adapt holster 150 (initially designed, structured and/or purposed for a waist belt concealment) for a deep concealment. Here, machine screws 116 may be used to fasten holster assembly 200 to holster body 120 (FIG. 3B). For example, machine screws 116 may be disposed through holes 212, and secured by matching threads in holes 110 (shown in FIG. 1B but not shown in FIG. 2). Spacers 152 may be disposed between holster assembly 200 and wing feature 108 while allowing machine screws 116 to pass through (FIG. 3A) to be secured by threads in holes 110. In one implementation, machine screws 116 may comprise a pair of machine screws 106 that are repurposed. Alternatively, machine screws 116 may be threaded like threading on machine screws 106 and be longer than machine screws 106 to account for a thickness spacers 152 and adapter 202. Spacers 152 may be formed from any suitable rigid or foam material, such as a suitable polymer.

In an embodiment, belt 205 may be formed from an inelastic material comprising webbing, sewn fabric and/or laminated fabric, such as nylon webbing made to MIL-W-17337 standard and specification, for example. Such an inelastic webbing may provide stability while being worn and allow for use of different extremis hand-to-hand techniques for retaining a holstered firearm against a violent attempt at take-away. In alternative implementations, belt 205 may be constructed to have some degree of elasticity for greater comfort. Belt 205 comprises a first end 204 attached to a first end 240 of adapter 202. Belt 205 may also comprise and a second end (not shown) that is to be looped through buckle 220 and cinched at a second end 242 of adapter 202 (e.g., to secure assembly 200 against a wearer's body snugly in a deep concealment). First end 204 of belt 205 is to be affixed to the first end 240 of adapter 202 by a first fastener 230. Fabric loop 206 is shown to be looped through buckle 220 and attached to the second end of adapter 202 by a second fastener 232. Fabric loop 206 may be formed from a nylon canvas, laminate materials, Tegris® (carbon-fiber analogue) or kydex, or a combination thereof. In a particular implementation, fabric loop 206 may comprise a combination of Acronym fabric (dual-layer laminated nylon canvas) and Tegris® material, for example. Adapter 202 may be formed from a flexible solid material such as Tegris® or other carbon fiber and/or thermoplastic material that is laser cut, for example. Adapter 202 is perforated with holes 208 at first end 240 and second end 242 of adapter 202. Fasteners 230 and 232 may secure first end 204 of belt 205 and/or fabric loop 206 selectively to different holes 208 to adjust and/or tailor a fit of holster body 150 against a wearer's body in a deep concealment. In a particular implementation, fasteners 230 and 232 may comprise metal snaps or machine screws secured by threaded nuts (not shown) to enable convenient adjustments to obtain a comfortable and/or optimal fit. To further secure holster assembly 200 and holster 150 against a wearer's body, leg leash 218 may be attached to adapter 202 by garter 216 looped through hole 214.

Figure 4:
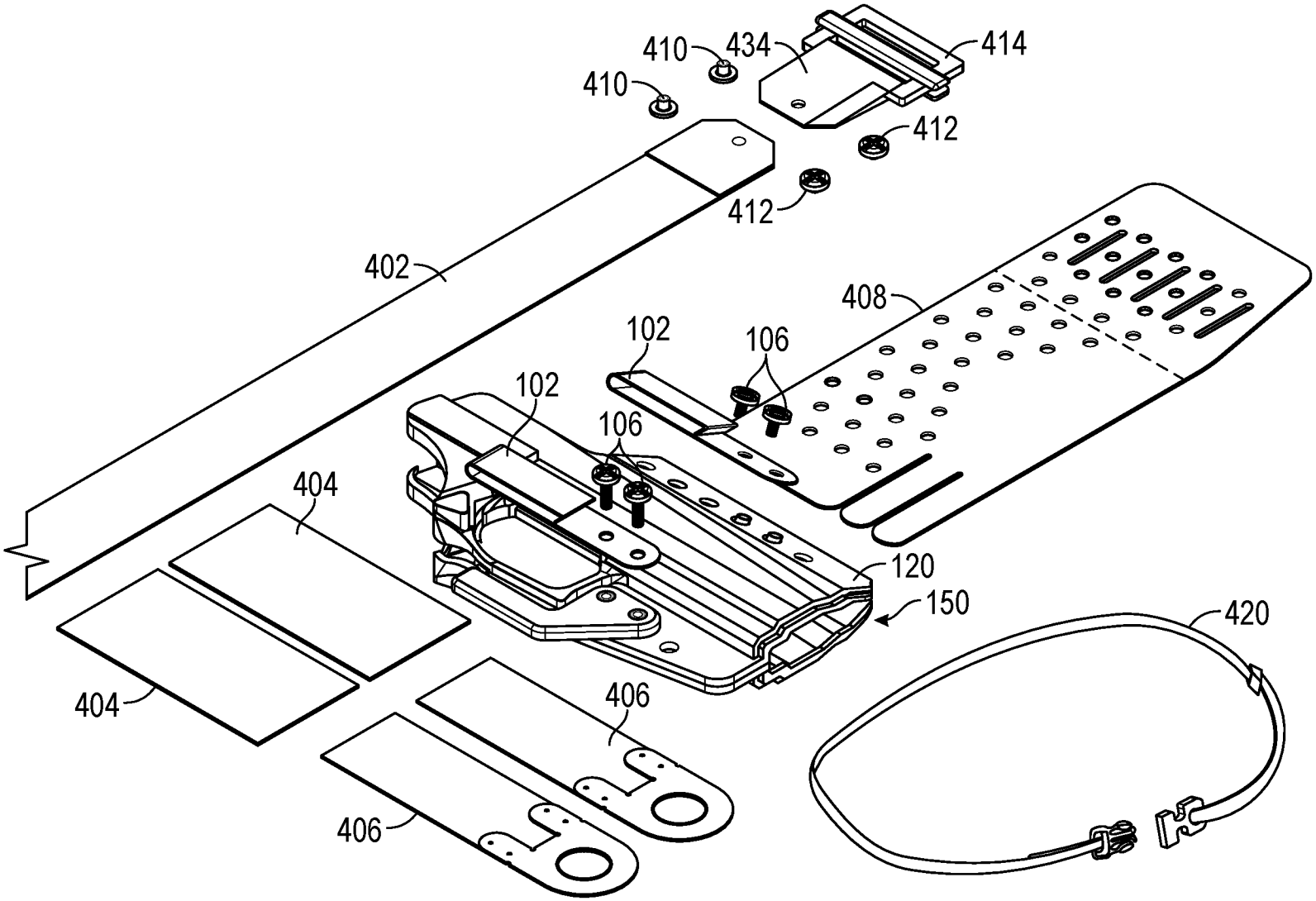
FIG. 4 is a schematic view of an apparatus to adapt a firearm holster for deep concealment according to an alternative embodiment.

FIG. 4 is a schematic view of an apparatus to adapt a firearm holster for deep concealment according to an alternative embodiment. As discussed above, overhooks 102 may be removed by removing machine screws 106 to provide holster 150. Strips 404 may comprise a flexible/deformable substrate (e.g., of a suitable polymer) having a glue adhesive (e.g., peel and stick) on a first side/surface and a fabric hook and fastener material (e.g., Velcro® material) on a second side/surface opposite the first side/surface. Each of leg leash hangers 406 may comprise a flexible substrate (e.g., of a suitable polymer) having a side/surface including a fabric hook and fastener material adapted to fasten to a fabric hook and fastener material of a strip 404.

Figure 5:
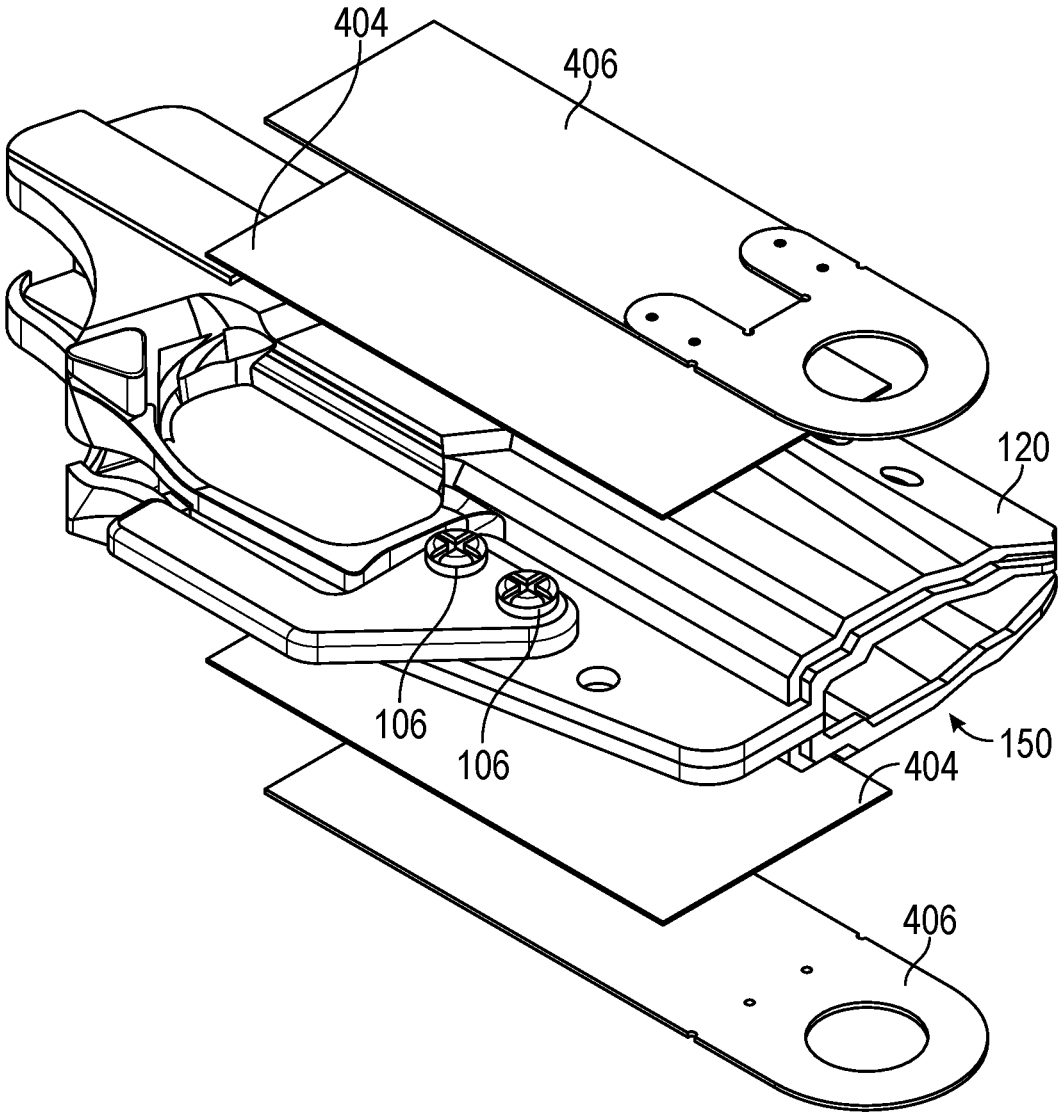
FIGS. 5 and 6 are schematic views of a holster and structures that may be adhered to the holster for deep concealment according to an embodiment.
Figure 6:
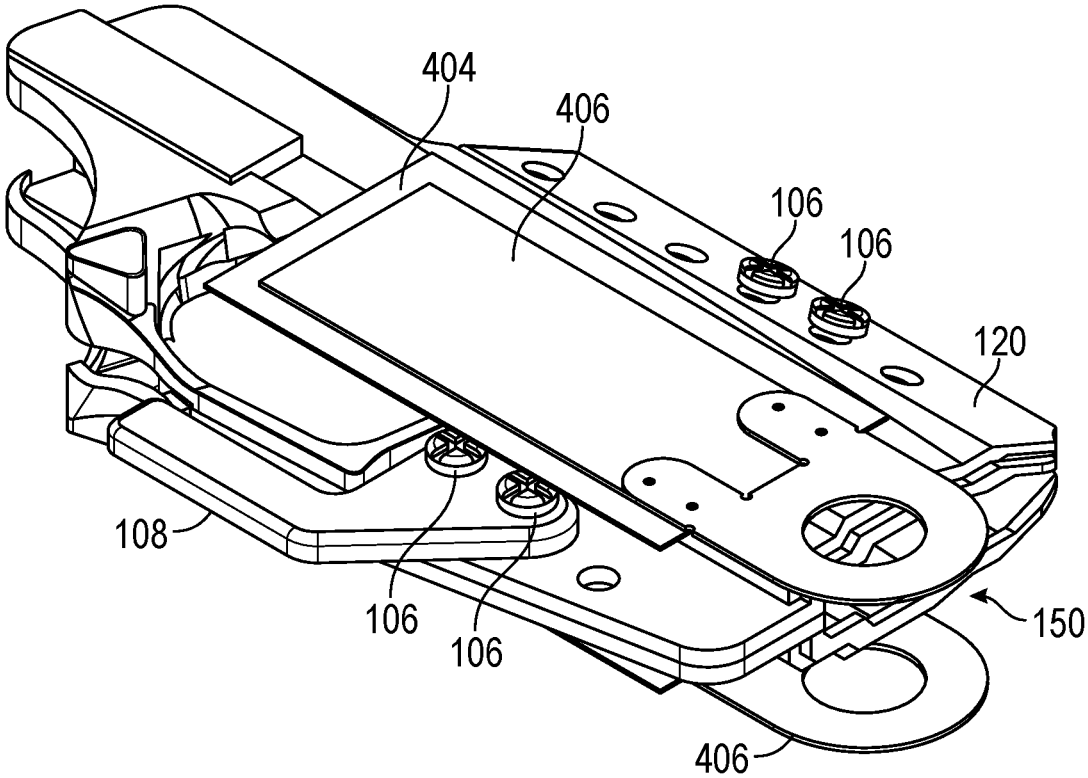

As shown in FIGS. 5 and 6, first sides/surfaces of strips 404 having a glue adhesive may be affixed to opposite sides of holster body 120. In particular implementation, strips 404 may be sufficiently flexible/deformable to conform to a non-planar surface of holster body 120 Fabric hook and fastener material of leg leash hangers 406 may be removably affixed to corresponding fabric hook and fastener material of strips 404 (where strips 404 are affixed to holster body 120 by glue adhesion).

Figure 7:
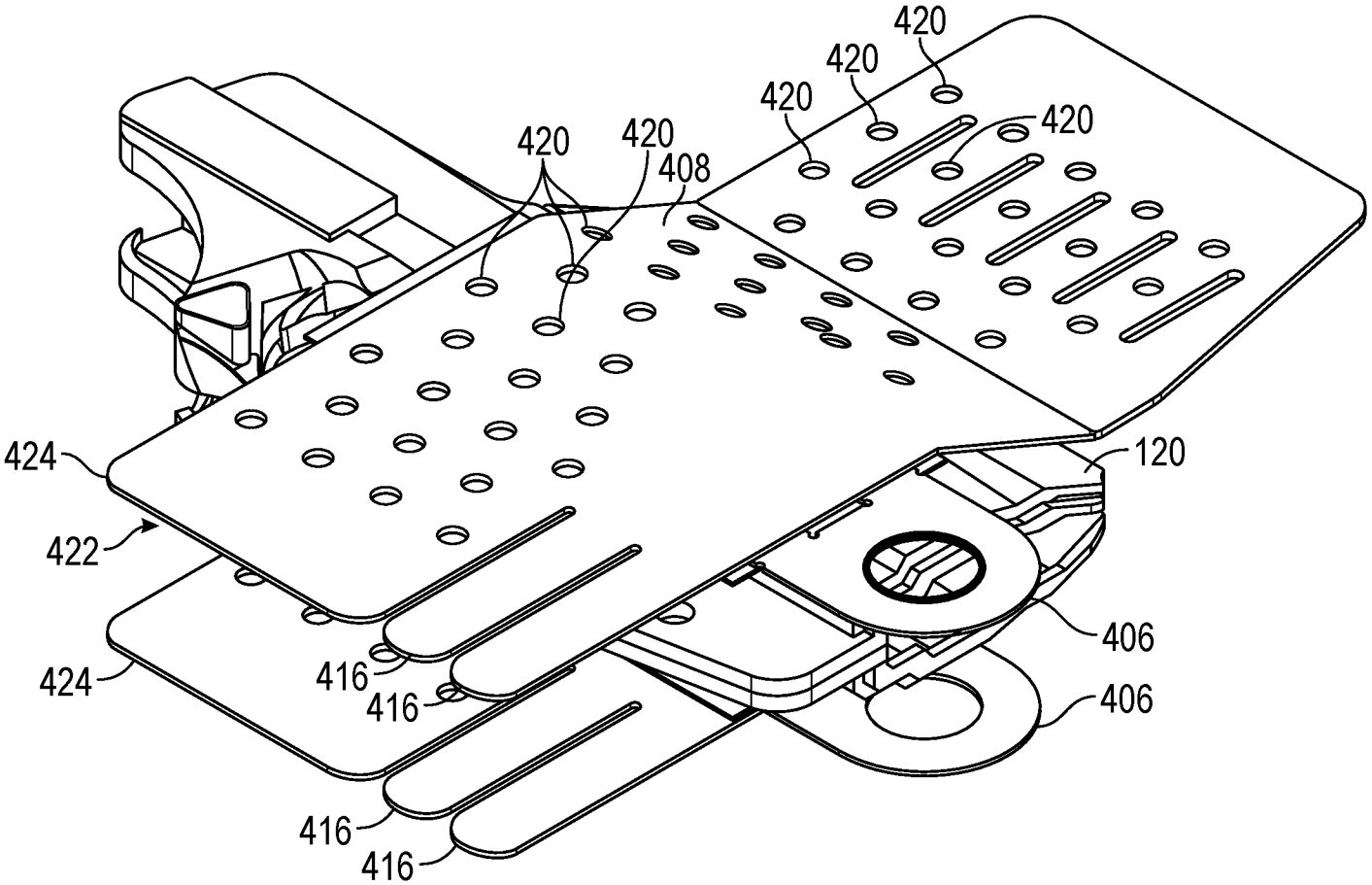
FIGS. 7, 8 and 9 are schematic views of a holster combined with additional structures to facilitate attachment to a belt for a deep concealment according to an embodiment.

Adapter 408 may be formed from a flexible fabric such as leather, nylon, a laminate of pile-tape and hook-tape materials (e.g., Velcro®)-made OneWrap™ material) or similar hook/pile combination materials, laminate materials (e.g. hypalon) or coated fabrics (e.g. Biothane TPU-coated material and webbing), just to provide a few examples. Adapter 408 may be precision cut (e.g., using a computer numeric controlled cut using a blade or laser) according to a particular pattern as shown in FIGS. 4 and 7 to comprise features including opposing flaps 424 to form a pocket 422 to receive holster body 120. Opposing flaps 424 may comprise partially detached elongated portions 416 that enable movement independent of remaining portions of opposing flaps 424. With holster body 120 disposed within pocket 422, opposing flaps 424 may be folded over to enclose and/or envelop holster body 120. Additionally, partially detached elongated portions 416 may be tucked as shown so as to enable support of holster body 120 under gravity. In a particular implementation, elongated portions 416 may be folded over to enclose and/or envelop holster body 120 within pocket 422, as with opposing flaps 424; and/or may be interlocked into a latticework for conformity to a smaller or tapering example of holster body 120 within.

Figure 8:
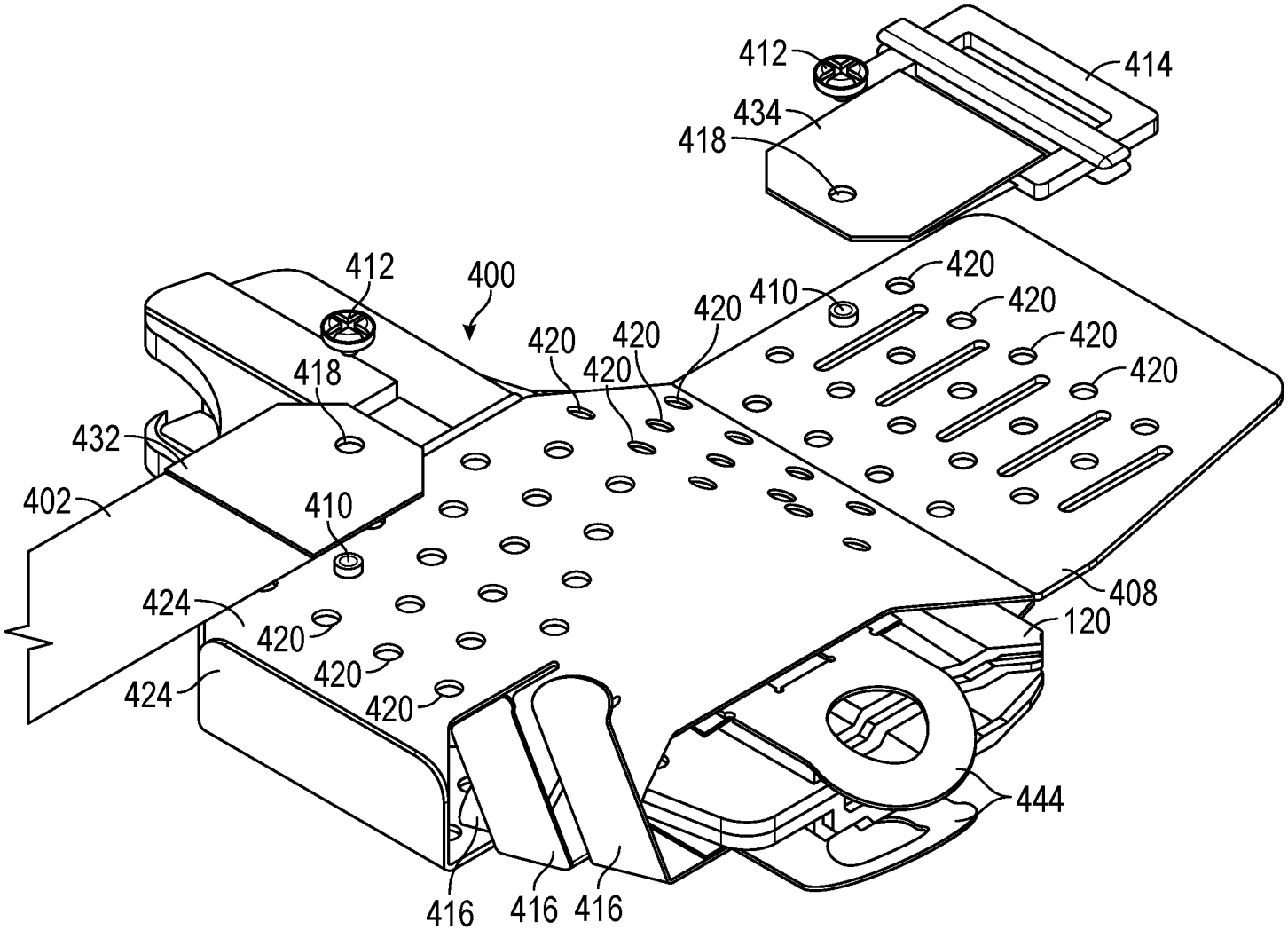
Figure 9:
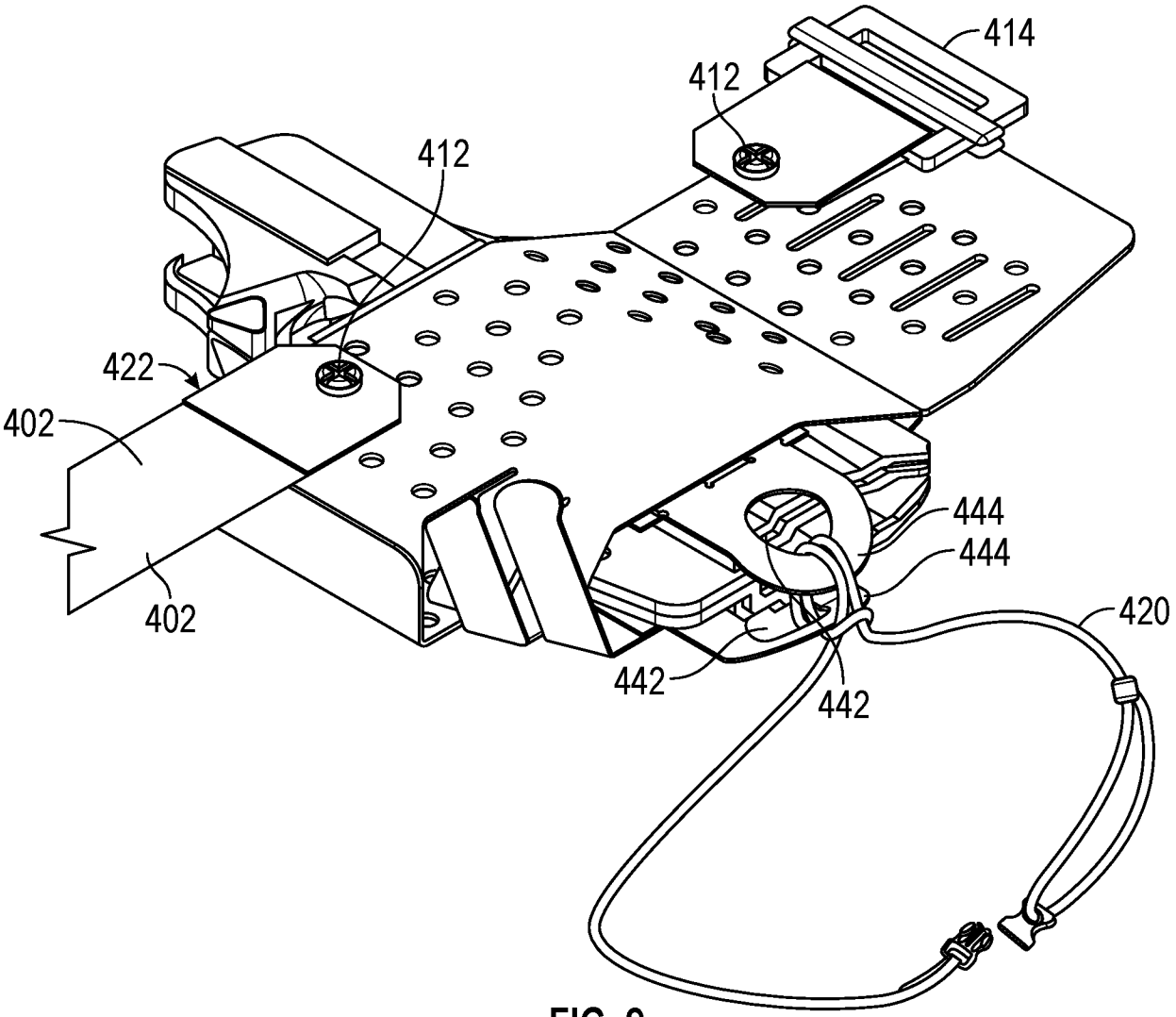

Binding posts 410 and corresponding screws 412 may form fasteners to affix belt 402 and buckle 414 to adapter 408. Adapter 408 may be perforated with holes 420 through which binding posts 410 may be disposed as shown in FIG. 8. Screws 412 may be fitted through holes 418 formed in first end 432 of belt 402 and fabric loop 434 to mate with binding posts 410. In an implementation, holes of binding posts 410 may be threaded to match threading of screws 412. A second end of belt 402 (not shown) may be looped through buckle 414 to be cinched and to tighten holster assembly 400 against a wearer's body. As shown in FIG. 9, leash hangers 406 may comprise end portions 444 having holes 442 formed therein. According to an embodiment, a particular implementation, end portions 444 may be formed of any sufficiently durable material capable of being computer numeric controlled (CNC) cut by blade or laser; to include nylon canvas, laminate materials, coated fabrics, and Velcro® made OneWrap™. End portions 444 may be attached to leash hangers 406 via stitching, ultrasonic- or heat-welding, or the use of fasteners (e.g. flared eyelet). In a particular implementation, end portions 444 may be composed of hypalon or HANK material that is CNC laser-cut and then sewn to strip-cut Velcro® OneWrap™ leash hangers 406. Leg leash 420 may be looped through holes 442 of leg leash hangers 406 to further secure holster assembly 400 and closed around a wearer's leg to further secure holster assembly 400 against the wearer's body. Leg leash 420 may comprise a flat or tubular webbing of a narrow width, such as ¼"/6 mm tubular webbing or gutted 550/650-spec parachute cordage (a.k.a. "para-cord"), which may be combined with a small releasable buckle/closure and a small webbing tri-glide/slider (e.g., a ¼" compatible side-release buckle and a ¼"/7 mm bikini slider).

In this context, "contiguous" should be interpreted broadly so as to include and/or encompass the terms like "part of," "disposed on," "proximate to," "in contact with," or like terms. In some instances, application of external force may comprise, for example, a pressure applied by a forward movement of a thumb of a wearer of a holster assembly so as to facilitate a linear sliding of an item, such as a handgun, for example, from holster body 120, as will be seen.

FIGS. 10A and 10B are schematic illustrations of example deep concealment of a holster assembly worn by a wearer. FIG. 11 is a schematic illustrations of example deep concealment of a holster assembly worn by a wearer. As shown in FIG. 11, a holster assembly comprising a holster body 558 is suspended from a pants belt 550 (pulled through loops 560 and worn on the outside of the wearer's garment/pants 562) and pant waist 554 by overhooks 556. As shown, a handgun 552 secured in holster body 558 is secured within pant waist 554 between pant waist 554 and the wearer's body. FIGS. 10A and 10B, on the other hand, illustrate use of an adapter, such as adapter 202, for a deep concealment of a firearm. As illustrated in FIGS. 10A and 10B, adapter 202 may be secured against a wearer's by belt 205, while belt 205 is secured against the wearer's body independently of any garment (e.g., independently of a pant waist or waist belt). As shown in FIG. 10A, adapter 202 is to secure handgun 502 in holster body 503 underneath pants 504 and over undergarment 505. As shown in FIG. 10B, adapter 202 is to secure handgun 522 in holster body 523 underneath pants 525 underneath shirt 527.

Accordingly, as was indicated, a deep concealment holster assembly disclosed herein may provide benefits. For example, as a stand-alone unit, it may be capable of being worn with unstructured clothing, such as clothing that may be worn without support of a waist belt, as one example, while retaining or maximizing holster's tactical ability (e.g., one-handed withdrawal, re-holstering, etc.) without compromising concealability and/or everyday wearing comfort. Thus, a deep concealment holster assembly may better conform to an applicable portion and/or shape of a wearer's body, at-rest and/or in-motion, for example, may provide for more consistent retention of a handgun or other item(s) regardless of presence and/or tension of a trouser belt, may allow for one-handed withdrawal and/or re-holstering, may address or alleviate skin irritability issues, may provide for more consistent positioning and/or orientation of a firearm, or the like. Of course, such a description of certain aspects of a deep concealment holster assembly and its benefits is merely an example, and claimed subject matter is not so limited.

References throughout this specification to one implementation, an implementation, one embodiment, an embodiment and/or the like means that a particular feature, structure, and/or characteristic described in connection with a particular implementation and/or embodiment is included in at least one implementation and/or embodiment of claimed subject matter. Thus, appearances of such phrases, for example, in various places throughout this specification are not necessarily intended to refer to the same implementation or to any one particular implementation described. Furthermore, it is to be understood that particular features, structures, and/or aspects described are capable of being combined in various ways in one or more implementations and, therefore, are within intended claim scope, for example. In general, of course, these and other issues vary with context. Therefore, particular context of description and/or usage provides helpful guidance regarding inferences to be drawn.

In the drawings and/or description, as was indicated, like parts and/or features are typically marked throughout the specification and/or drawings with the same reference numerals, respectively, if applicable. Again, the drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed herein may be employed separately or in any suitable combination to produce desired results.

While there has been illustrated and described what are presently considered to be example features and/or aspects, it will be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular examples disclosed, but that such claimed subject matter may also include all aspects falling within the scope of the appended claims, and equivalents thereof.

The terms, "and", "or", "and/or" and/or similar terms, as used herein, include a variety of meanings that also are expected to depend at least in part upon the particular context in which such terms are used. Typically, "or" if used to associate a list, such as A, B or C, is intended to mean A, B, and C, here used in the inclusive sense, as well as A, B or C, here used in the exclusive sense. In addition, the term "one or more" and/or similar terms is used to describe any feature, structure, and/or characteristic in the singular and/or is also used to describe a plurality and/or some other combination of features, structures and/or characteristics. Likewise, the term "based on" and/or similar terms are understood as not necessarily intending to convey an exclusive set of factors, but to allow for existence of additional factors not necessarily expressly described. Of course, for all of the foregoing, particular context of description and/or usage provides helpful guidance regarding inferences to be drawn. It should be noted that the following description merely provides one or more illustrative examples and claimed subject matter is not limited to these one or more examples; however, again, particular context of description and/or usage provides helpful guidance regarding inferences to be drawn.

What is claimed is:

1. A method comprising:

detaching one or more fasteners from a holster body of a holster assembly, the one or more fasteners to enable securing the holster assembly to a wearer for a waist belt concealment of a handgun; and affixing an adapter to the holster body to configure the adapter to suspend the holster body against a body of the wearer independently of a belt for suspending a garment on the wearer, wherein the adapter to enable a securing of the holster assembly against the body of the wearer for a deep concealment of the handgun by tightening an adapter belt, a first portion of the adapter belt being coupled to a first point of attachment to the adapter and a second portion of the adapter belt being coupled to a second point of attachment to the adapter different from the first point of attachment to the adapter.

2. The method of claim 1, wherein the one or more fasteners comprise one or more overhooks.

3. The method of claim 2, wherein detaching the one or more fasteners comprises removing one or more first machine screws from one or more threaded holes formed in the holster body to enable removal of the overhooks.

4. The method of claim 3, wherein affixing the adapter to the holster body further comprises:

securing at least one second machine screw in at least one of the one or more threaded holes to secure the adapter to the holster body.

5. The method of claim 1, wherein the adapter is perforated with holes to provide multiple optional points of attachment to at least the first portion of the adapter belt.

6. The method of claim 1, and wherein the adapter further comprises:

a semi-flexible structure to comprise a first end to couple to the first portion of the adapter belt, and a second end to couple to the second portion of the adapter belt, wherein the semi-flexible structure is adapted to deform and shape to the body of the wearer.

7. The method of claim 6, wherein the semi-flexible structure is mechanically coupled to a leg leash, the leg leash to attach the semi-flexible structure to a leg of the wearer.

8. The method of claim 1, wherein the adapter comprises a flexible fabric adaptable to form a pocket to hold the holster body.

9. The method of claim 1, wherein the adapter comprises a flexible fabric adaptable to form a pocket to hold the holster body.

10. The method of claim 1, and further comprising tightening the adapter belt to apply a tension on the adapter between the first point of attachment and the second point of attachment so as to secure the holster body snugly against the body of the wearer.

11. A method comprising:

detaching one or more fasteners from a holster body of a holster assembly, the one or more fasteners to enable securing the holster assembly to a wearer for a waist belt concealment of a handgun;

affixing an adapter to the holster body, wherein the adapter to enable a securing of the holster assembly against a body of the wearer for a deep concealment of the handgun; and adjusting a fixed attachment of the adapter to a belt, a first portion of the belt being coupled to a first point of attachment to the adapter and a second portion of the adapter being coupled to a second point of attachment to the adapter different from the first point of attachment to the adapter, so as to adjust a fixed orientation of the holster body relative to the belt.

12. The method of claim 11, wherein the one or more fasteners comprise one or more overhooks.

13. The method of claim 12, wherein detaching the one or more fasteners comprises removing one or more first machine screws from one or more threaded holes formed in the holster body to enable removal of the overhooks.

14. The method of claim 13, wherein affixing the adapter to the holster body further comprises:

securing at least one second machine screw in at least one of the one or more threaded holes to secure the adapter to the holster body.

15. The method of claim 11, and further comprising tightening the belt to secure the holster body snugly against the body of the wearer.

16. The method of claim 15, wherein:

the adapter is perforated with holes to provide multiple points of attachment to the belt; and adjusting the fixed attachment of the adapter to the belt so as to adjust the fixed orientation of the holster body relative to the belt by selecting one or more of multiple optional points of attachment to achieve the adjusted fixed orientation of the holster body relative to the belt.

17. The method of claim 15, wherein tightening the belt to secure the holster body snugly against the body of the wearer comprises applying a tension on the adapter between the first point of attachment and the second point of attachment.

18. The method of claim 11, and wherein the adapter for further comprises:

a semi-flexible structure to comprise a first end to couple to the first portion of the belt, and a second end to couple to the second portion of the belt, wherein the semi-flexible structure is adapted to deform and shape to the body of the wearer.

19. The method of claim 18, wherein the semi-flexible structure is mechanically coupled to a leg leash, the leg leash to attach the semi-flexible structure to a leg of the wearer.

* * * * *